United States Patent [19]

Grimland

[11] 3,998,370

[45] Dec. 21, 1976

[54] FEED APPARATUS

[75] Inventor: Charles J. Grimland, Garland, Tex.

[73] Assignee: Micro Forms, Inc., Garland, Tex.

[22] Filed: Sept. 15, 1975

[21] Appl. No.: 613,344

[52] U.S. Cl. ..... 226/150; 226/11; 226/46; 226/159; 226/164

[51] Int. Cl.[2] ..... B65H 17/44

[58] Field of Search ..... 226/11, 46, 47, 146, 226/150, 159, 162, 164

[56] References Cited

UNITED STATES PATENTS

| | | | |
|---|---|---|---|
| 2,381,571 | 8/1945 | Buchan | 226/162 X |
| 2,787,465 | 4/1957 | De La Motte | 226/150 |
| 3,159,325 | 12/1964 | Toensing | 226/150 |

*Primary Examiner*—Richard A. Schacher
*Attorney, Agent, or Firm*—Jack A. Kanz

[57] ABSTRACT

Disclosed is apparatus for feeding length stock into a work tool such as a punch press. The feed apparatus includes a pneumatically operated traveling clamp and a pneumatically operated fixed position clamp. The traveling clamp is linearly reciprocated between two positions by a pneumatically operated lever and linkage which varies the velocity of the traveling clamp proportionately with distance from the fixed position clamp to decelerate the traveling clamp as the feed stock reaches the desired position in the work tool. Interdependent pneumatic control systems for sequencing the advancement of the stock with the cyclic operation of the work tool and for sequencing the clamps with the feed advancing mechanism are also disclosed.

22 Claims, 3 Drawing Figures

FEED APPARATUS

This invention relates to feed stock handling apparatus. More particularly, it relates to apparatus for feeding raw stock into cyclic working tools such as punch presses, die presses, cutters and the like.

In most metalworking tools, such as punch presses and the like, raw stock in the form of rods, wire, ribbons, etc., is fed into the metalworking tool from a stock supply. The stock supply may be in the form of a roll or long sections of stock which must be fed into the press in accurately measured lengths. For efficiency of operation, the feed operation must be coordinated with the operation cycle of the working tool to position the stock in the working tool as rapidly as the tool can accommodate it.

Since the metalworking tool is cyclic in operation, the required section of feed stock must be precisely positioned within the press at the appropriate time in the work cycle. If the stock material is not properly positioned the part will be improperly formed. More seriously, if the feed stock is not properly placed in the working tool, the tool itself may be damaged.

It is desirable, of course, that the stroke of the feed apparatus be variable as desired to accommodate various working operations. Likewise, the feed apparatus should include means for detecting malfunctions in the feeding operation and control means to prevent damage to the working tool in case of malfunction of the feed mechanism or upon reaching the end of the stock, etc.

In accordance with the invention, pneumatically operated stock feeding apparatus is provided which not only precisely measures and positions the feed stock in the working tool at the appropriate time in the work cycle; but also detects any malfunction of the feed apparatus and controls the working tool accordingly. Positive positioning of the feed stock is accomplished by a first pneumatically operated clamp mounted for reciprocal movement between two stop positions. The position of the stops is adjustable to control the length of the feed stroke. The base stop includes a pneumatically operated fixed position holding clamp. Control of the moving clamp and fixed clamp is interconnected so that both cannot normally be open at the same time, thus controlling the feed cycle. Operation of the feed cycle is initated by the working tool so that the feed cycle is coordinated with the work cycle of the tool.

The moving clamp is reciprocally moved by a pivoting lever which is activated by a collapsing linkage powered by a double-acting pneumatic cylinder. The collapsing linkage causes the velocity of the advancing stock to be proportional to the distance of the moving clamp from the fixed clamp. Therefore, as the feed stock is advanced into the machine, the velocity of the stock is proportionately decreased to zero as the stock approaches the desired location. Accurate positioning of the feed stock is determined by closing of appropriately positioned pneumatic limit valves which must be closed to continue the sequence of operation. The invention thus provides means for accurately and rapidly measuring and positioning lengths of feed stock in a work tool in a sequence coordinated with the work cycle of the tool. Moreover, the feed stock is decelerated as it approaches the desired position, thus eliminating or substantially reducing the impact shock on the stop blocks used to stop forward motion of the stock. The feed apparatus is readily adjustable to accommodate various lengths and sizes of feed stock, and is interlocked so that the working tool is stopped if a malfunction occurs anywhere in the feed system. The system may be fabricated using commercially available pneumatic equipment and is not only extremely rapid and relatively inexpensive, but also exhibits extremely high reliability and precision operation.

Other features and advantages of the invention will become more readily understood from the following detailed description taken in connection with the appended claims and attached drawings in which:

It will be readily appreciated that various cycle feed apparatus may be used in connection with various cyclic machine tools. As used herein the terms 'machine tool' and 'metalworking tool' are intended to include any machine which performs repetitive or cyclic operations on sections of feed stock fed into the tool from lengths of raw stock. Thus the terms may include machines such as cutters, punch presses, die presses, lathes, routers, drill presses and the like as well as machines which attach additional components to the raw stock such as automatic welders and the like. It will be further understood that the apparatus is not limited to use in connection with metalworking tools. On the contrary, the apparatus may be used in connection with supplying raw stock in the form of bars, rods, tubes or extrusions and the like of metal, wood, plastics, fabrics or various combinations thereof, and may likewise be adapted to advance partly finished or assembled goods through various types of work stations in an assembly process or the like.

For illustrative purposes the preferred embodiment of the invention is described herein with reference to feed apparatus for advancing a metal strip into a punch press from a supply stock roll. It will be readily understood, however, that the principles of the invention are equally applicable to apparatus for advancing other forms and types of materials into other types of machines. It will also be recognized that although the apparatus is described as a feed mechanism for feeding stock into a machine tool, the apparatus could be used in a similar manner for drawing feed stock through a machine tool where it is more desirable to handle the stock after it has been processed by the machine tool.

Figure 1:
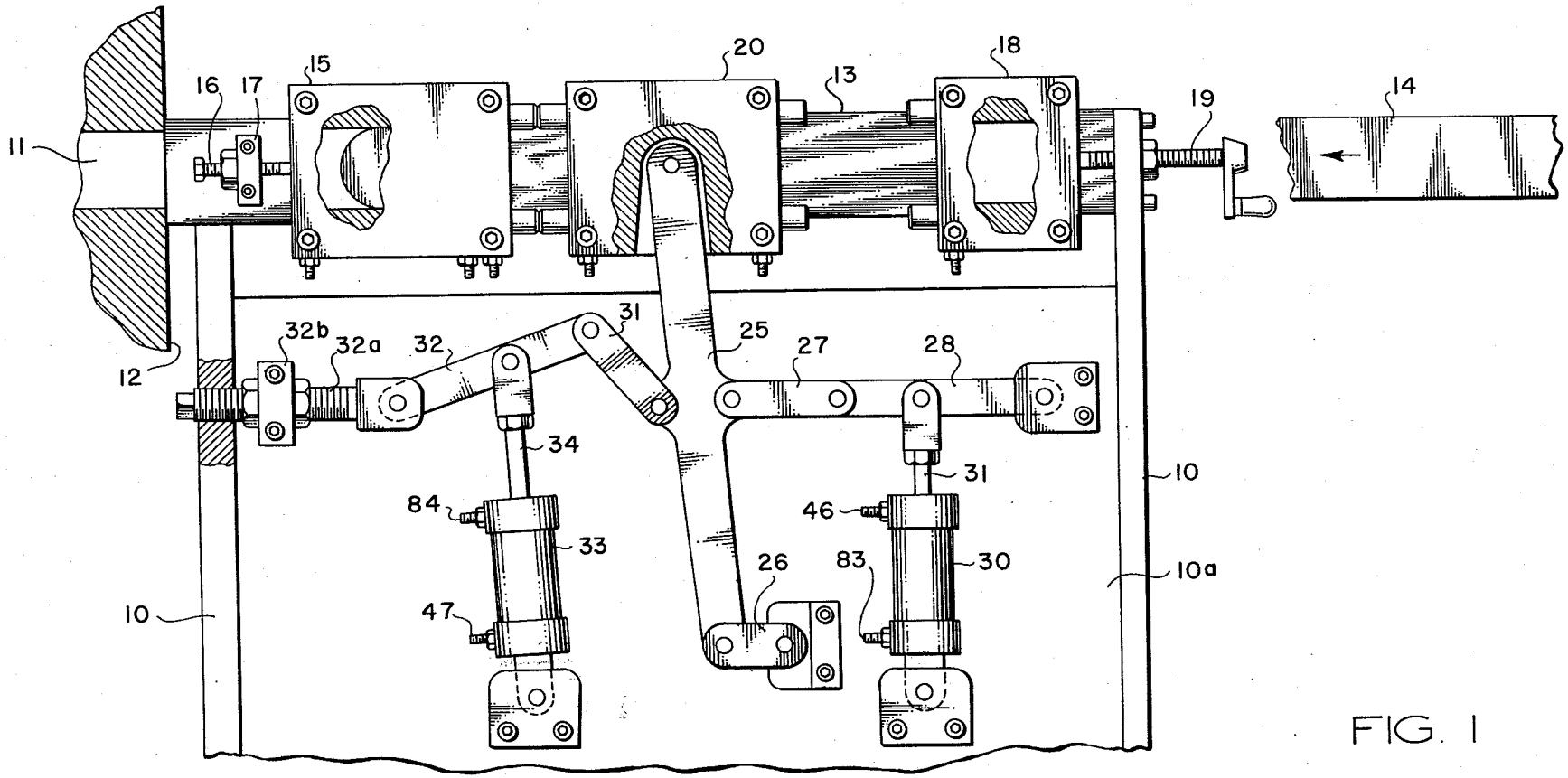
FIG. 1 is a top plan view, partially in section, of the preferred embodiment of the stock feed apparatus of the invention.
Figure 2:
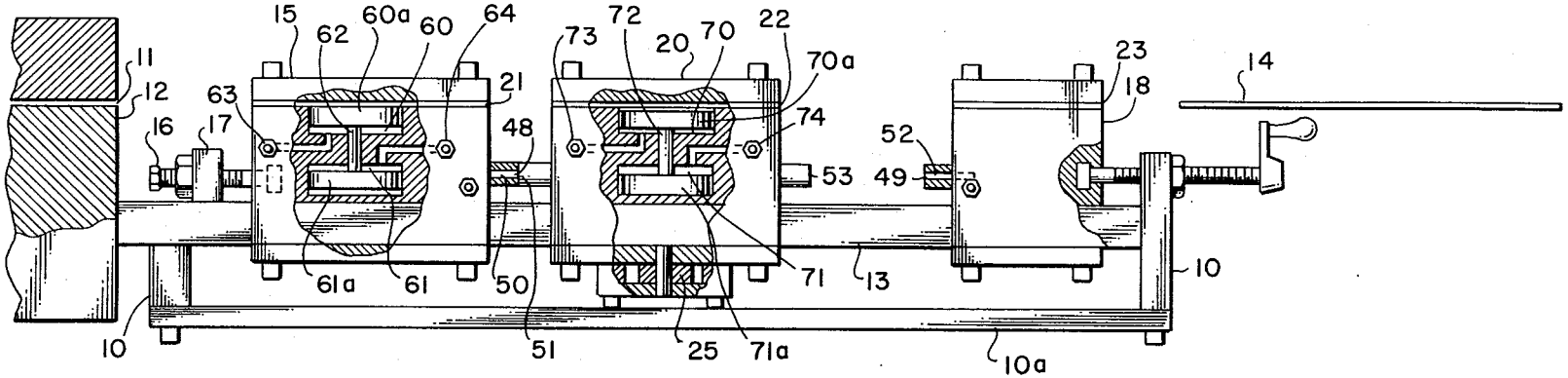
FIG. 2 is a side elevational view of the apparatus of FIG. 1, partially in section.

The preferred embodiment of the apparatus of the invention will now be described with reference to a feed apparatus for advancing a metal ribbon into a punch press as illustrated in FIG. 1 and FIG. 2. As illustrated in the drawings, the feed apparatus includes a frame 10 which is mounted adjacent the feed entry II of a machine tool such as a punch press or the like, only a portion of which is shown at 12. The frame 10 supports an elongated beam 13 which is positioned parallel to the feed entry II and to the path of the stock 14. A fixed position clamp 15 mounted on the beam 13 is adjustably fixed in spaced relation to the feed entry II by means of an adjustment screw 16 threadedly engaging boss 17 and having on end secured to the fixed position clamp 15.

A guide block 18 is mounted near the end of beam 13 opposite the fixed clamp 15 and is adjustable secured in position by means of adjustment bolt 19 threadedly engaging the frame 10 and having one end secured in the guide block 18.

A traveling clamp 20 is mounted for reciprocal movement along beam 13 between a first position adjacent the guide block 18 and a second position adjacent the fixed position clamp 15. Clamp 15, traveling clamp 20 and guide block 18 each have apertures 21, 22 and 23, respectively, passing therethrough aligned with the feed entry II and the path of stock 14. The cross-sectional dimensions of the apertures 21, 22 and 23 substantially correspond to the cross-sectional dimensions of the stock 14. Fixed clamp 15 and guide block 18 also include pneumatic limit switches in the form of bleed valves which cooperate with traveling clamp 20 to control the stroke of the traveling clamp 20 as will be explained hereinafter. Accordingly, the relative positions of fixed clamp 15 and the guide block 18 are adjustable to adjustably control the travel of the traveling clamp 20 and the bleed valves provide means for signaling the end of each stroke of the traveling clamp 20.

Traveling clamp 20 is moved between the first and second positions by a lever 25 having one end pivotally connected with the traveling clamp and the opposite end pivotally attached to the base plate 10a of the frame 10 by means of a linkage 26. Motive force is applied to lever 25 by a linkage comprising two interconnected elongated members 27 and 28. One end of the first elongated member 27 is attached to lever 25 and the opposite end of the second elongated member 28 is attached to baseplate **10*a* of the frame 10. A pneumatic cylinder 30 is connected between the base plate 10*a* and the second elongated member 28 so that extension of the piston 31 from cylinder 30 causes collapsing of the linkage, thereby causing the traveling clamp 20 to move toward guide block 18. Conversely, when piston 31 is retracted into cylinder 30, the linkage comprising elongated members 27 and 28 is extended to its fullest length, thereby advancing the traveling block 20 toward the fixed clamp 15. It will be observed that stock passing through guide block 18, traveling clamp 20 and fixed clamp 15 will be advanced into feed entry II only when fixed clamp 15 is open, traveling clamp 20 is closed and piston 31 is retracted to cause full extension of linkage 27 and 28. When the linkage 27 and 28 reaches the fully extended position, motion of traveling clamp 20 ceases. Fixed clamp 15 must then be closed and traveling clamp 20 opened to hold the stock 14 in a fixed position while traveling clamp 20 returns to repeat the feed cycle. Sequencing of the clamps and cylinder 30** will be more fully explained in connection with control apparatus described hereinafter.

It will be observed that in moving the traveling clamp 20 from the first position to the second position (to advance the feed stock) linkage 27 and 28 is moved from a collapsed condition to a fully extended position. It will also be observed that as clamp 20 moves from the first position to the second position the interconnection point between the elongated members 27 and 28 of the linkage moves along an arc while the piston 31 of cylinder 30 moves substantially linearly along a line substantially parallel to the lever 25. Accordingly, if the piston 31 is moved at a constant velocity the interconnected ends of the linkage 27 and 28 move to the left of FIG. 1 at varying velocity; the velocity in that direction being proportional to the horizontal distance of the interconnected ends from the point at which the linkage is fully extended. The varying velocity of movement of the linkage 27 and 28 is thus transmitted directly to the traveling clamp 20 by lever 25 so that the velocity at which traveling clamp 20 travels in moving from a position adjacent to the guide block 18 to a position adjacent the fixed clamp 15 is proportional to the distance of the traveling clamp from the fixed clamp 15.

Fixed clamp 15 is adjustably positioned so that traveling clamp 20 is adjacent fixed clamp 15 at the pont where linkage 27 and 28 is fully extended; thereby permitting the velocity of the traveling clamp 20 to approach zero as the traveling clamp 20 approaches the fixed clamp 15. Since the traveling clamp 20 moves toward the fixed clamp 15 at a decreasing velocity, the feed stock advanced thereby also approaches the fixed clamp and the feed entry II of the punch press with reducing velocity; thereby eliminating or substantially reducing the impact shock of the traveling clamp on the limit stop block. It will be appreciated that when the feed stock is massive, substantial momentum may be built up in the feed stock during the feed stroke. In prior art feed mechanisms, the momentum is dissipated by allowing the advancing clamp to impact on a stop block to mechanically stop the advance of the stock. Such high impact shocks cause rapid wear on the feed mechanism and cause precision of the feed stroke to suffer. Accordingly, repeated adjustment of the feed stroke is required. In contrast, in the feed apparatus of the invention the velocity of the feed stock automatically approaches zero as the terminal position is approached, thereby greatly reducing or eliminating the high impact shock at mechanical limit stops. Since the impact is reduced, wear on the advancing mechanism is reduced and precision control can be maintained.

In the embodiment of the invention illustrated in FIG. 1, lever 25 is also connected to a complimentary linkage comprising two elongated members 31 and 32 interconnected with a second pneumatic cylinder 33. The complementary linkage 31, 32 is disposed diametrically opposed from the linkage 27, 28 and interconnected with piston 34 of cylinder 33 in a like manner. The complementary linkage, however, is collapsed when linkage 27 and 28 is fully extended; while linkage 27 and 28 is collapsed when the complementary linkage 31 and 32 is fully extended. Control of the complementary linkage 31 and 32 and second cylinder 33 is interconnected with first cylinder 30 as described hereinafter. The complementary linkage 31 and 32 and cylinder 33 serve to cooperate with the linkage 27 and 28 and cylinder 30 to assure more uniform movement of traveling clamp 20 and to permit traveling clamp 20 to approach guide block 18 with decreasing velocity. In the embodiment illustrated, complementary linkage 31 and 32 is anchored to the frame 10 by means of a threaded stub **32*a*. The threaded stud engages a boss 32b and the length of the stud may be varied as desired to vary the length of the return stroke of the traveling clamp 20.**

The preferred pneumatic control system for operating the feed apparatus described hereinabove will now be described with reference to FIG. 3. The basic system comprises a five-ported pneumatic valve which alternatively closes either the traveling clamp or the fixed clamp. Signals for operating the valve are derived from pneumatic switches which report the position of the traveling clamp with respect to the guide block 18 or the fixed clamp 15. The five-ported valve simultaneously controls the pilot ports of another valve which alternatively moves the traveling block in response to signals received from the pneumatic switches. Accordingly, operation of the clamps and movement of the traveling clamp 15 is interlocked by the pneumatic control system so that operation of the clamps and feed stock is properly sequenced. Interlocking controls for stopping the press are also illustrated.

Figure 3:
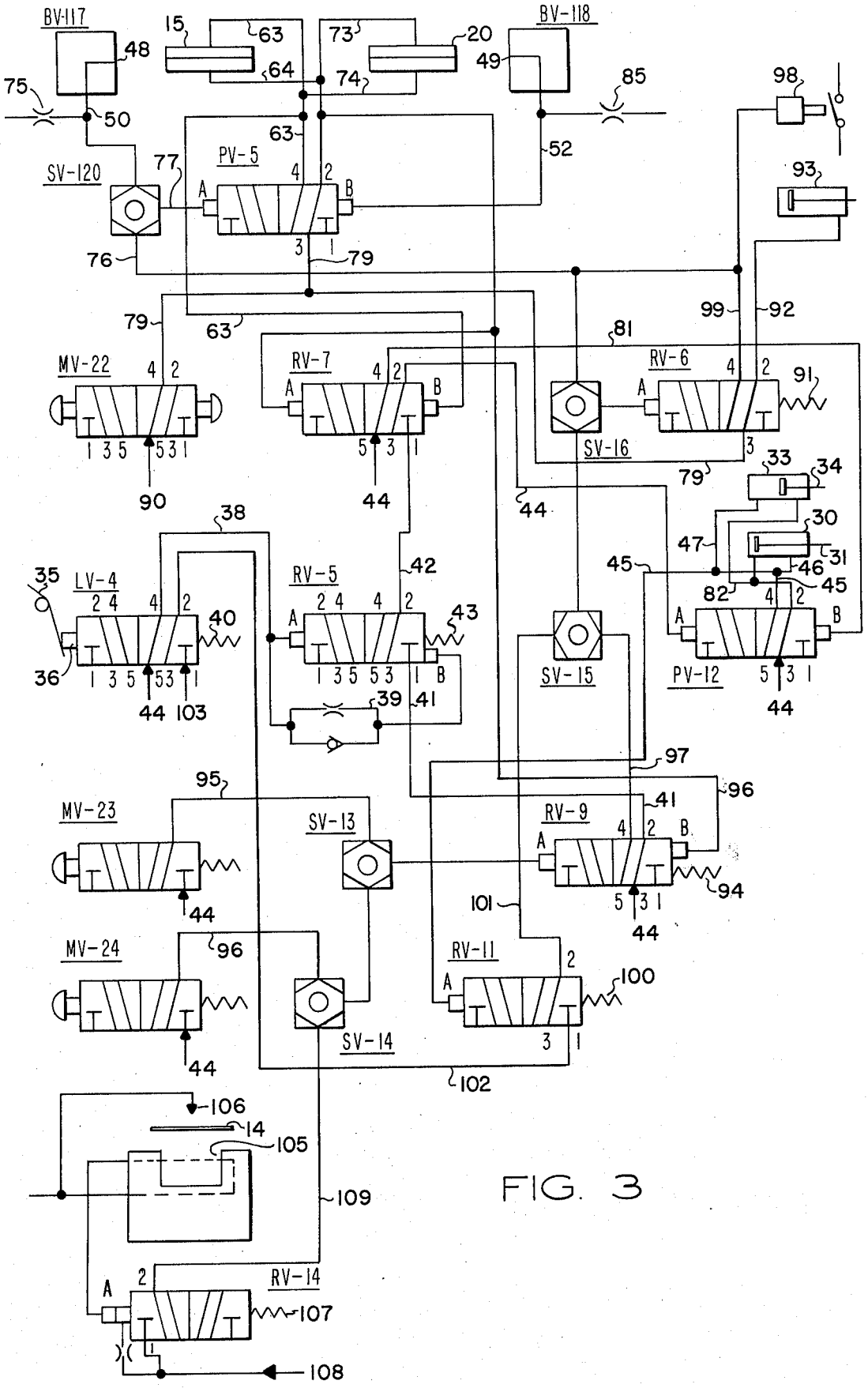
FIG. 3 is a schematic illustration of the preferred embodiment of the pneumatic system for controlling the apparatus shown in FIGS. 1 and 2.

Referring now to FIG. 3, it will be observed that the feed cycle is initiated by camming means 35 which is preferably operated by the ram of the punch press or equivalent cyclicly operable part of the work tool which moves at a predetermined time during the work cycle to signal the beginning of the period during which the stock may be advanced into the machine. In the embodiment illustrated the cam 35 maintains the spool 36 of limit valve LV-4 to the right as shown in the drawing. As the ram is withdrawn the cam 35 releases spool 36. Spring 40 thus urges the spool 36 to the left allowing fluid flow between ports 5 and 4 of limit valve LV-4. Pressurized air from source 44 thus enters line 38 to trigger a one shot timer comprising relay valve RV-5 and timing circuit 39. Pressurized air from line 38 applied to pilot A of relay valve RV-5 thus temporarily connects ports 1 and 2 of relay valve RV-5 and a pulse of pressurized air passes from line 41 to line 42. It will be observed that when the pressure at pilot B is equal to the pressure at Pilot A, as determined by the timing circuit 39, spring 43 shifts RV-5 to disconnect lines 41 and 42 and vent line 42 through port 3. When the ram next engages cam 35, spool 36 is shifted to the right venting line 38 through port 3 of limit valve LV-4. The timing circuit and relay valves are then re-set for the next signal to repeat the operation.

The pulse from relay valve RV-5 is conducted through line 42 to port 1 of relay valve RV-7. If pressure is applied to pilot A of relay valve RV-7 (indicating that the traveling clamp 20 is closed as described hereinafter), the pulse from line 42 passes through ports 1 and 2 of relay valve RV-7 and through line 44 into pilot A The power valve PV-12. The spool of power valve PV-12 is thus shifted to the right, interconnecting ports 3 and 4 of power valve PV-12 and permitting pressurized air from input 44 to enter line 45. Line 45 is connected with inlet 46 of cylinder 30 and inlet 47 of cylinder of 33, thus advancing the traveling clamp 20 toward the fixed clamp 15.

Fixed clamp 15 and traveling clamp 20, in accordance with the preferred embodiment of the invention, are pneumatically operated clamps and control thereof may therefore be interconnected with the pneumatic control system for the feed apparatus. As illustrated in FIG. 2, fixed clamp 15 preferably comprises a housing defining a pair of coaxial cylinders 60 and 61. Pistons 60a and 61a interconnected by shaft 62 are mounted for reciprocal movement within cylinders 60 and 61, respectively. The outer surface of piston 60a provides the clamping surface for fixed clamp 15 when cylinder 60 is pressurized. Fluid communication to cylinders 60 and 61 is provided by pneumatic lines 63 and 64, respectively. It will thus be observed that when pneumatic pressure is applied to cylinder 60 through line 63, fixed clamp 15 is closed. When cylinder 61 is pressurized by pressurized fluid entering line 64, fixed clamp 15 is open.

Similarly, traveling clamp 20 comprises a housing defining a pair of coaxial cylinders 70 and 71. Pistons 70a and 71a interconnected by shaft 72 are mounted for reciprocal movement within cylinders 70 and 71, respectively. The outer surface of piston 70a provides the clamping surface for traveling clamp 20 when cylinder 70 is pressurized. Fluid communication to cylinders 70 and 71 is provided by pneumatic lines 73 and 74, respectively. It will thus be observed that when pneumatic pressure is applied to cylinder 70 through line 73, traveling clamp 20 is closed. When cylinder 71 is pressurized, traveling clamp 20 is open. Referring again to FIG. 3, it will be observed that pneumatic line 74 is interconnected with pneumatic line 63 so that whenever fixed clamp 15 is closed traveling clamp 20 is simultaneously opened. Likewise, line 64 is interconnected with line 73 so that whenever traveling clamp 20 is closed fixed clamp 15 is opened. It will be observed that in the cross-coupled arrangement shown, both clamps are activated by double-acting cylinders and are thus positively opened and positively closed, and the same pneumatic pressure used to close one clamp is applied to simultaneously open the other clamp.

At the beginning of the feed stroke traveling clamp 20 must be closed and fixed clamp 15 must be open. To assure that the clamps are in the proper condition at the beginning of each cycle, operation of the feed cylinders is dependent upon a positive determination of the condition of the clamps. Sequencing of the clamps is controlled by bleed valves BV-117 and BV-118 incorporated in the fixed clamp 15 and guide block 18, respectively. As shown in FIG. 2, bleed valve BV-117 may be small orifice 48 in a pneumatic line 50 with its face aligned so that the orifice is blocked by a stop tab 51 carried on the traveling clamp 20 when the traveling clamp 20 reaches the second position. Likewise, bleed valve BV-118 may be a small orifice 49 in a pneumatic line 52 with its face aligned so that the orifice 49 is blocked by stop tab 53 carried on the traveling clamp when traveling clamp 20 is in the first position. The function of the bleed valves to control the feed sequence is illustrated in FIG. 3.

Referring again to FIG. 3 it will be observed that pressurized air entering port 3 of power valve PV-12 from source 44 is directed into line 45 when pilot A is pressurized, thereby causing lever 25 to move traveling clamp 20 to the left from the first position toward the second position. When traveling clamp 20 reaches the end of the feed stroke stop tab 15 blocks orifice 48. Air is continuously fed into line 50 through constriction 75; thus when orifice 48 is blocked pressure builds in line 50 causing shuttle valve SV-120 to close line 76 and charge pilot A of power valve PV-5 through line 77. When pilot A is charged the spool of PV-5 shifts to the right connecting line 63 and 79 through ports 3 and 4 of power valve PV-5. Pressurized air from line 79 thus enters line 63 to close fixed clamp 15 and open traveling clamp 20. Simultaneously, ports 2 and 1 of power valve PV-5 are interconnected; thus venting line 73 and permitting the traveling clamp 20 to open and fixed clamp 15 to close.

Line 63 is also connected to pilot B of relay valve RV-7. Thus when pressure is applied to line 63, indicating that fixed clamp 15 is closed, pilot B of relay valve RV-7 is charged causing the spool of relay valve RV-7 to shift to the left connecting port 5 with port 4. Therefore pressurized air from source 44 enters line 81 to charge pilot B of power valve PV-12 and simultaneously vent pilot A of power valve PV-12. Pressurized air from source 44 is then shifted from port 4 to port 2 of PV-12 and port 4 vented through port 5. Pressurized air entering through port 3 passes through port 2 into line 82 to charge cylinders 30 and 33 through cylinder ports 83, 84 respectively, causing the traveling clamp 20 to retract from the second position toward the first position. It will be observed, however, that as traveling clamp 20 reaches the first position stop tab 53 closes port 49 of bleed valve BV-118. Thus air entering line 52 through constriction 85 pressurizes pilot B of power valve PV-5 thereby closing traveling clamp 20 and venting fixed clamp 15.

Pilot B of power valve PV-12 will remain charged, thus maintaining the traveling clamp in the first position, until pilot A of relay valve RV-7 is charged. However, pilot A of relay valve RV-7 is charged by the pressure in line 73, thus the spool of RV-7 is shifted to the right to vent pilot B of power valve PV-12 and connect pilot A of PV-12 with line 42. Power valve PV-12, however, does not shift until a pulse is received on line 42 from the one shot timer. Thus the next feed stroke cannot occur until a starting pulse is received from line 42 as described above. The feed operation thus has completed one full cycle and is now reset for the next cycle upon receiving the required signal from cam 35.

Since the entire feed operation is dependent upon pilot A of relay valve RV-7 and initiation of the feed stroke cannot begin without pilot A being charged, manual control of the feed operation is readily provided by a manual valve MV-22. The manual valve MV-22 in the open condition permits pressurized air to enter line 79 from source 90 which provides the pressurization for the clamps and, depending upon the condition of power valve PV-5, charges pilots A or B or relay valve RV-7. Of course, when manual valve MV-22 is closed line 79 is vented and the spool of RV-7 remains in the last charged condition. However, since operation of the feed cycle is dependent upon a signal from the limit switch LV-4 to switch relay valve RV-5 and send a pulse through line 42, the mechanism cannot operate unless pressurized air is applied to line 41 entering port 1 of relay valve RV-5.

Line 79 is also connected to port 3 of relay valve RV-6. Relay valve RV-6 is normally shifted to the left by spring 91, thus permitting air from line 79 to pressurize line 92 which charges cylinder 93. Cylinder 93 is appropriately connected to operate the clutch on the press so that the press clutch is not engaged unless manual valve MV-22 is open and the feed system charged for operation. It will be observed that manual valve MV-22 does not initiate the feed mechanism. Instead, MV-22 merely engages the press clutch and provides pressure to close the traveling clamp 20 and open the fixed clamp 15, if pilot B of PV-5 is charged. Thus MV-22 does not start the feed cycle, but since the feed cycle cannot start unless traveling clamp 20 is closed, MV-22 must be open before the feed cycle may be initiated.

Additional automatic and manual control systems are incorporated in the apparatus of FIG. 3. As noted hereinabove the entire system is dependent upon a trigger pulse on line 42 from line 41 when the cam 35 initiates the feed cycle. Accordingly, line 41 is connected with a pressure source 44 through a relay valve RV-9. The automatic and manual control systems are conveniently connected to operate relay valve RV-9 and thereby prevent initiation of the feed cycle any time when the apparatus is to be stopped, such as when malfunction occurs, reaching the end of the feed material, or the like. As illustrated the spool of relay valve RV-9 is ordinarily shifted to the left by spring 94. Thus unless pilot A of RV-9 is charged, the valve is normally open and pressure from source 44 is applied line 41.

In FIG. 3 two manual stops switches MV-23 and MV-24 are shown. Switch MV-23 is a normally closed switch which permits pressurized air from source 44 to enter line 95 only when the switch is manually operated. Likewise, switch MV-24 is normally closed and permits pressurized air from source 44 to enter line 96 only when switch MV-24 is manually operated. Switch MV-23 may be conveniently located at the press itself to provide a manual shutdown switch at the press in the case of malfunction or other need to stop operation of the machine. Switch MV-24 may be conveniently located at the inspection station where the goods passing through the work tool are inspected. Accordingly, the operator of the inspection station may stop the operation of the machine by manually activating switch MV-24.

Switches MV-23 and MV-24 are gated through shuttle valves SV-13 and SV-14, respectively, to control pilot A of relay valve RV-9.

It will be noted that because of spring 94 relay valve RV-9 is normally open and pressurized air from source 44 passes therethrough and into line 41 unless sufficient pressure is applied to pilot A to overcome spring 94 and shift the valve. It will also be noted that the valve cannot be shifted when the traveling clamp 20 is closed since the pressure from source 90 applied to the traveling clamp through line 73 is also supplied to pilot B of relay valve RV-9 through line 96. The pressure of source 90 is greater than the pressure of source 44, therefore relay valve RV-9 will be held open so long as traveling clamp 20 is closed. However, if traveling clamp 20 is open, line 96 is vented and pressure applied to pilot A of RV-9 will shift the valve and connect pressurized source 44 with line 97. Accordingly, if either manual switch MV-23 or MV-24 is activated while traveling clamp is open, pilot A of RV-9 will be charged, shifting RV-9. When RV-9 is shifted port 2 is connected to port 1, thus venting line 41. With line 41 vented, no signal can be received at line 42 regardless of the action of the timing circuit. Furthermore, source 44 is connected to line 97 which charges pilot A of relay valve RV-6. As noted above, when RV-9 is shifted to the right the supply of pressurized air to the timing circuit dies. Therefore, as long as RV-9 is closed no signal can be applied to the timing circuit and the feed cannot operate. Furthermore, line 79 will be connected with line 99, thus charging pressure switch 98 to shut down the press motor. Line 99 also charges pilot A of power valve PV-5 through line 76 and shuttle valve SV-120, thus causing fixed clamp 15 to close and traveling clamp 20 to open. It will be observed, therefore, that activation of either MV-23 or MV-24 causes complete shut-down of the feeding operation, locks the fixed clamp 15, opens traveling clamp 20, disengages the clutch, and stops the press motor.

An additional protective interlock is provided in the control system illustrated in FIG. 3. Note that line 45, which is pressurized to operate the feed cylinders in the feed stroke, is also connected to pilot A of relay valve RV-11. The spool of RV-11 is normally biased to the left by spring 100, thus line 101 is vented through ports 2 and 3. However, when the feed cylinders are pressurized to advance the feed stock, the spool of RV-11 is shifted and line 101 connected to line 102. Line 102 is connected to port 2 of limit switch LV-4 and thus is vented through port 3 of limit switch LV-4 when cam 35 releases spool 36 of LV-4. However, whenever the press ram engages cam 35, signalling the end of the period in which feeding should be accomplished, spool 36 moves to the right and connects line 102 with pressure source 103 through ports 1 and 2 of limit switch LV-4. If no pressure is on line 45, relay valve RV-11 is shifted to the left and the pressure on line 102 is stopped at RV-11. However, if pressure is still on line 45, indicating that traveling clamp 20 has not reached the end of the feed stroke, ports 1 and 2 of RV-11 connect line 102 with line 101 and the pressure from source 103 is applied to pilot A of RV-6 through shuttle valves SV-15 and SV-16. As noted above, when pressure is applied to pilot A of RV-6, the press clutch is disengaged and pressure switch 98 is activated to shut down the press motor. It will thus be observed that any time the ram signals the end of the feed period and pressure is still on the feed cylinders, the press is automatically stopped, the fixed clamp closed and the traveling clamp opened. These conditions would be present, for example, if the feed stock were jammed or the feed stroke not yet complete for other reasons such as mis-timing, etc. Nevertheless, the press clutch is disengaged immediately to prevent damage to the press and the fixed clamp closed to prevent any further feeding.

It is also desirable that the work tool be automatically stopped if the supply of feed stock is interrupted. An interruption may occur, for example, if there is a break of discontinuity in the feed stock supply, or if the end of a roll or other length of feed stock is reached. In order to protect the work tool in case of an interruption of feed stock supply, a pneumatic subsystem for determining interruptions in the stock supply is shown in FIG. 3. The subsystem comprises a transverse interruptible jet such as sold by Parker Hannifin Corporation of Otsego, Mich. The detector basically comprises a pair of opposed streams of air focused on each other across a gap as indicated at 105. The stock material 14 passes over the gap 105. A third stream of air is directed at the gap from a nozzle 106. However, so long as the stock 14 is present, the stock 14 prevents air from nozzle 106 from acting on the opposed airstreams. Thus no signal is applied to Pilot A of relay valve RV-14 and spring 107 maintains port 1 closed. Port 1 is connected to a pressure source 108. When the stock material 14 is not blocking nozzle 106, the jet from nozzle 106 disturbs the opposed flow and the signal is applied to pilot A. Thus relay valve RV-14 is shifted to connect pressure source 108 with line 109. Pressure on line 109 charges Pilot A of relay valve RV-9, thus stopping the entire operation as described above. It will be readily observed that various other parameters may be detected by similar means and the signal from the detector applied to a relay valve such as RV-14 to provide automatic shut-down of the operation. For example, width or thickness gauges may be employed. Likewise, similar arrangements may be used to monitor the finished product and automatically stop the feed and work tool whenever the finished product is determined to be improperly formed.

The various pressure sources used in the system illustrated may be any suitable pressurized gas, such as air, nitrogen or the like. Furthermore, the principles of operation are not limited to the use of pneumatic fluids. Obviously hydraulic fluids may be used in similar manner to accomplish the desired functions. The operating pressure may vary, of course, with the system employed. It will be recognized that the pressure required will depend on the mass of the traveling clamp, the stock to be moved, and the configuration and size of the motive cylinders. Therefore, the values of pressures used in any system are not critical but may be adjusted to accommodate the system and components employed. For proper operation of a system employing the control functions of relay valve RV-9, it is critical that pressure source 90 be greater than either source 44 or source 108. In the embodiment illustrated, a pressure of 120 psia is satisfactory for source 90, a pressure of 80 psia is satisfactory for source 44, a pressure of 35 psia is satisfactory for source 103, and a pressure of 50 psia is satisfactory for source 108. Even smaller pressures are satisfactory for supplying air to the bleed valve BV-117 and BV-118.

From the foregoing it will be observed that the feed apparatus of the invention provides highly reliable and precision operation but uses only simple and readily available components. The elliptical feed stroke greatly reduces the impact shock at the end of the feed stroke, thereby aiding in precision of operation and greatly reducing wear and mis-alignment problems. Furthermore, the unique control system advantageously provides automatic interlocks to prevent damage to the machine in case of malfunction and thus permits virtually unsupervised operation of the work tool.

Although the invention has been described with particular reference to a punch press, it will be readily appreciated that the principles thereof are equally applicable to other types of work tools and may be utilized to advance feed shock and control operation of other tools in a similar manner. It is to be understood, therefore, that although the invention has been described with particular reference to a specific embodiment thereof, the form of the invention shown and described in detail is to be taken as the preferred embodiment of same, and that various changes and modifications may be resorted to without departing from the spirit and scope of the invention as defined by the appended claims.

What is claimed is:

1. Apparatus for feeding length stock into a cyclic working tool comprising:

a. frame means mounting clamp means in a fixed position adjacent to the feed entry of said tool, b. traveling clamp means aligned with the fixed position clamp means and mounted for linear reciprocal movement between a first position removed from the fixed position clamp means and a second position adjacent the fixed position clamp means, and c. means for moving said traveling clamp means between said first and second positions including a lever having one end connected to the traveling clamp means and coupled with a double-acting cylinder by a linkage comprising two interconnected elongated members, one end of one of said members connected to said lever and the opposite end of the other of said members connected at a fixed point on said frame means, and said cylinder connected between a fixed point on said frame means and one of said elongated members.

2. Apparatus as defined in claim 1 wherein one end of said lever is connected to said traveling clamp means and the other end of said lever is attached to said frame means by attachment means permitting said lever to move along its longitudinal axis, and wherein said linkage is attached to said lever at a point approximately midway between the ends thereof.

3. Apparatus as defined in claim 2 wherein said double-acting cylinder is mounted with its central axis substantially parallel with the longitudinal axis of said lever.

4. Apparatus as defined in claim 3 including a second linkage connected between said lever and said frame means comprising two interconnected elongated members extending in a direction opposite to the first said linkage, and including a second double-acting cylinder connected between said second linkage and said frame means, the central axis of said second double-acting cylinder being substantially parallel with said lever.

5. Apparatus as defined in claim 4 including pneumatic pressure means operatively interconnected with said first and second double-acting cylinders so that both cylinders cooperate to move said lever.

6. Apparatus as defined in claim 1 including control means for activating said double-acting cylinder comprising a. a pressure source,
b. means for determining the position of said traveling clamp means,
c. means for determining the operative condition of said fixed position clamp means,
d. valve means responsive to the position of said traveling clamp means and to the condition of said fixed clamp means and said traveling clamp means and which activates said double-acting cylinder to move said traveling clamp means from said first position toward said second position when said traveling clamp is closed, said fixed clamp is open, and said traveling clamp is in said first position.

7. Pneumatically operated reciprocal feed apparatus comprising:

a. frame means mounting a pneumatically operated clamp means in a fixed position,
b. pneumatically operated traveling clamp means mounted for reciprocal movement between a first position removed from the fixed position clamp means and a second position adjacent said fixed position clamp means,
c. a first bleed valve mounted on said fixed position clamp means,
d. first stop tab means mounted on said traveling clamp means and adapted to close said first bleed valve only when said traveling clamp means is in said second position;
e. second bleed valve mounted at a position removed from said fixed position clamp means,
f. second stop tab means mounted on said traveling clamp means and adapted to close said second bleed valve only when said traveling clamp means is in said first position,
g. pneumatically operated means for moving said traveling clamp means,
h. means for closing said fixed position clamp means and opening said traveling clamp means when said first bleed valve is closed by said first stop tab, and
i. means for opening said fixed position clamp means and closing said traveling clamp means when said second bleed valve is closed by said second stop tab.

8. Apparatus as defined in claim 7 wherein said pneumatically operated means for moving said traveling clamp means comprises a lever having one end connected to said traveling clamp means and coupled with a double-acting cylinder by a linkage comprising two interconnected elongated members, one end of one of said members connected to said lever and the opposite end of the other of said members connected at a fixed point on said frame means, and said cylinder connected between a fixed point to said frame means and one of said elongated members.

9. Apparatus as defined in claim 7 wherein said fixed position clamp means and said traveling clamp means are cross-coupled pneumatic clamps operatively interconnected so that pneumatic pressure applied to close either clamp is applied to open the other clamp.

10. Apparatus as defined in claim 9 including first valve means for selectively applying a source of pneumatic pressure to alternately open and close said clamp means, said first valve means being responsive to the condition of said first and second bleed valves.

11. Apparatus as defined in claim 10 including second valve means responsive to the condition of said clamp means for controlling the operation of said double-acting cylinder.

12. Apparatus as defined in claim 11 wherein said second valve means permits said double-acting cylinder to move said traveling clamp only if said traveling clamp is closed and said fixed clamp is open.

13. Apparatus as defined in claim 12 including a third valve means and timing circuit for operating said third valve means, said third valve means being opened to relay a pressure signal to said second valve means in response to an external signal and automatically closed upon expiration of a time interval determined by said timing circuit.

14. Apparatus as defined in claim 13 including fourth valve means for supplying a pressure signal source to said third valve means if said traveling clamp means is closed and said fixed clamp means in open.

15. Apparatus as defined in claim 7 including control apparatus comprising:

a. means for providing a signal to initiate the feed stroke, and
b. means for preventing initiation of the feed stroke if said traveling clamp is not closed, said fixed position clamp is not open, and said traveling clamp is not in said first position at the time said signal is provided.

16. Apparatus for feeding length stock into a cyclic working tool comprising a. fixed position clamp means adjacent the feed entry of said tool,
b. traveling clamp means aligned with said fixed position clamp means and mounted for reciprocal linear movement between a first position removed from said fixed position clamp means and a second position adjacent said fixed position clamp means.
c. means for moving said traveling clamp means from said first position to said second position at a varying velocity proportional to the distance between the said traveling clamp means and the said second position,
d. means for providing a first signal indicating the beginning of a period in which feed stock may be advanced into said cyclic working tool, and
e. control means responsive to said first signal and for determining the condition and position of said traveling clamp means upon receipt of said first signal, said control means providing a second signal to initiate movement of said traveling clamp means from said first position toward said second position only if said traveling clamp means is in said first position, said traveling clamp means is closed and said fixed position clamp means is open.

17. Apparatus as defined in claim 16 including means for moving said traveling clamp means from said second position to said first position at a varying velocity proportional to the distance between said traveling clamp means and said first position.

18. Apparatus as defined in claim 16 including means for simultaneously closing said fixed position clamp means and opening said traveling clamp means when said traveling clamp means is in said second position, and for simultaneously closing said traveling clamp means and opening said fixed position clamp means when said traveling clamp means is in said first position; and for maintaining said fixed position clamp means closed when said traveling clamp means is moving from said second position toward said first position and for maintaining said fixed position clamp open and said traveling clamp closed when said traveling clamp is moving from said first position toward said second position.

19. In combination with the apparatus of claim 16, control apparatus including means for blocking the pressure source for supplying said second signal if said traveling clamp means is open.

20. The combination set forth in claim 19 wherein said means for blocking the pressure source for supplying said second signal includes detection means for indicating the condition of the feed stock and supplying a signal to control said means for blocking the pressure source for supplying said second signal.

21. The combination set forth in claim 19 wherein said means for blocking the pressure source for supplying said second signal is a valve which diverts said pressure source to operate means for stopping operation of said working tool and closing said fixed position clamp means.

22. Apparatus as defined in claim 16 wherein said means for providing a first signal includes means for providing a control signal and further including a control valve responsive to the condition of said means for moving said traveling clamp means and activated by said control signal to stop operation of said working tool if said means for moving said traveling clamp means is activated at the time of receiving said control signal.

* * * * *